United States Patent [19]

Krasser

[11] Patent Number: 4,704,594

[45] Date of Patent: Nov. 3, 1987

[54] OVERLOAD PROTECTION SWITCH WITH SINGLE PUSH BUTTON FOR TURN-ON AND TURN-OFF

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 923,650

[22] Filed: Oct. 27, 1986

[30] Foreign Application Priority Data

Oct. 29, 1985 [DE] Fed. Rep. of Germany ..... 8530597

[51] Int. Cl.[4] ..... H01H 71/16

[52] U.S. Cl. ..... 337/66; 337/68

[58] Field of Search ..... 337/66, 68, 64, 70, 337/75

[56] References Cited

U.S. PATENT DOCUMENTS 2,952,757 9/1960 Ellenberger ..... 337/66

*Primary Examiner*—Harold Broome

*Attorney, Agent, or Firm*—Spencer & Frank

[57] ABSTRACT

A push button actuated overload protection switch includes a bimetal member which holds a contact bridge in a latched ON position. The contact bridge is configured as an approximately rectangular angle lever and is mounted on a switch rod so as to be freely pivotal and displaceable in the axial direction. The contact bridge is under the pressure of a switch spring which is supported at the switch rod. During turn-off the contact bridge is released by the bimetal member and pressed against an oblique abutment at the housing and pivoted into an oblique engagement position, whereby a projection on the switch rod engages the contact bridge. Subsequent actuation of the push button causes the contact bridge to be transferred into its ON position in which the pressure of the switch spring presses it into engagement behind a contact piece of the bimetal member and into contact with a contact terminal. The push button is provided with a deflection lug which extends alongside the switch rod and deflects the bimetal member when the push button is depressed so that it releases the turn-off movement. This makes it possible to manually turn off the switch by pressure actuation.

11 Claims, 9 Drawing Figures

OVERLOAD PROTECTION SWITCH WITH SINGLE PUSH BUTTON FOR TURN-ON AND TURN-OFF

BACKGROUND OF THE INVENTION

The present invention relates to a push button overload protection switch of the type disclosed in U.S. Pat. No. 2,952,757. Such a switch includes a contact bridge configured as an approximately rectangular angle lever which is latched by an undeflected bimetal member and is thus held in its ON position. The contact bridge is mounted on a switch rod so as to be freely pivotal and displaceable in the axial direction of the switch rod. The switch rod is rigidly connected with a push button that is spring tensioned in a direction opposite to the direction of push button pressure, with the switch rod extending in the direction of push button pressure. A switch spring is provided which, during turn-off of the switch, is effective in the longitudinal direction of the switch rod opposite to the direction of push button pressure for pushing a first arm of the contact bridge against an oblique abutment of a switch housing so that the contact bridge is brought into an oblique engagement position, pivoted with respect to its ON position. In the oblique engagement position, the contact bridge engages a projection on the switch rod wherein by actuation of the push button in the direction of push button pressure, the switch spring is caused to exert pressure on the first arm of the contact bridge to pivot the contact bridge from the oblique engagement position into the ON position whereby the first arm of the contact bridge engages behind a contact piece of the bimetal member which is in its undeflected position, wherein a second arm of the contact bridge is brought into a position substantially parallel to the switch rod for pressing against a contact terminal that is fixed to the housing. Additionally, a manually actuatable device is provided for deflecting the bimetal member to thus release a turn-off movement controlled by the switch spring.

The prior art overload protection switch of the above-mentioned type is distinguished by its very small size so that a multitude of such switches can be placed in a row in a space saving manner. The manually actuatable device to deflect the bimetal is constituted by a second push button which is mounted in the switch housing so as to be displaceable parallel to the push button which switches the device on and is thereby charged by a spring which pushes it back into its inactive position. This arrangement of a second push button for manual turn-off is expensive to manufacture and takes up much space.

SUMMARY OF THE INVENTION

It is an object of the present invention to provide a switch of the above-mentioned type which, without losing any of its functions, takes up less room for the accommodation of its operational parts and can be manufactured with lower fabrication and material costs.

The above and other objects of the invention are accomplished in the context of a push button overload protection switch of the type described above wherein, according to the invention, the push button for turning on the device is equipped with a deflection lug disposed adjacent the switch rod so that, when the push button is depressed substantially completely a turn-off movement is effected wherein the deflection lug deflects the bimetal member by charging it directly, causing the contact piece to unlatch the first arm of the contact bridge, allowing the switch spring to pivot the contact bridge into the oblique engagement position.

The invention eliminates the need for the provision of a second push button to deflect the bimetal member and to thus effect the turn-off movement. Rather, the function of the second push button is implemented in the form of a deflection lug which is a component of a single push button of the switch which serves to turn-on the device. Compared with the above-described prior art switch, only the length of the displacement path of the push button has become somewhat longer. The push button can be pressed somewhat deeper into the switch housing than is necessary for operation of the above-mentioned prior art switch. On this additional insertion path of the push button, the bimetal member is deflected. During the turn-on movement of the push button, this deflection has no effect on the contact bridge. If, however, the push button is depressed completely with the switch in the ON position, the deflection of the bimetal member caused by the deflection lug causes the bimetal member to release the contact bridge, causing the switch to automatically switch off under the pressure of the switch spring.

In a particularly space saving configuration of the switch according to the invention, the bimetal member is fastened to the bottom of the switch housing and projects approximately parallel to the switch rod in a direction toward the push button. Further, electrical terminals are brought through the bottom of the housing, and the bimetal member, the switch rod, the contact bridge and the contact terminal lie approximately in a longitudinal center plane of the switch housing. Additionally, the deflection lug extends outside the longitudinal center plane parallel to the switch rod, and the bimetal member has a free end at which the contact piece extends laterally of the bimetal member into the range of movement of the deflection lug.

According to a further aspect of the invention the switch housing has tubular outline and is suitable for installation in a known manner in a double-D recess in a switching panel or the like in place of a conventional melting fuse insert. Because of its inventive features, the switch requires no more space in depth than a conventional melting fuse and nevertheless has a double insulation in the actuation region, while the required spacing is maintained between the actuation region and the voltage carrying parts of the switch.

In accordance with further features of the invention the switch is provided with a guide piece made of an insulating material which is fastened to the housing between the contact bridge and the push button, wherein the guide piece serves to partition the interior of the housing so that all of the voltage carrying parts of the switch are on the side of the guide piece facing the bottom of the housing. The guide piece is disposed near the push button end of the housing and includes an abutment for the push button spring. These features provide particularly good insulation of the voltage carrying parts from the push button which is accessible to human contact.

According to further aspects of the invention the guide piece serves multiple purposes. The guide piece is, according to the invention, provided with a surface which constitutes the oblique housing abutment for the contact bridge. Additionally, the guide piece is configured to include spring hooks which clamp two housing halves together. The push button and parts associated therewith together with the guide piece can be preassembled and can easily be inserted for final installation of the switch into the housing half previously equipped with the bimetal member and the connecting contacts. It is then only necessary to place the other housing half on top and to press it together with the previously equipped housing half. The guide piece then clamps together both housing halves in their final installed position. A mutual, unreleasable riveting between the two housing halves can then be performed in a simple manner.

The invention will be described in an exemplary manner with reference to the drawing figures.

BRIEF DESCRIPTION OF THE DRAWINGS

- in FIG. 6, at the transition from the OFF position to the locked position;
- in FIG. 7, shortly before the subsequent locking of the contact bridge;
- in FIG. 8, in the locked position;
- in FIG. 9, shortly after manual turn-off with the push button held down.

DESCRIPTION OF THE PREFERRED EMBODIMENT

Figure 1:
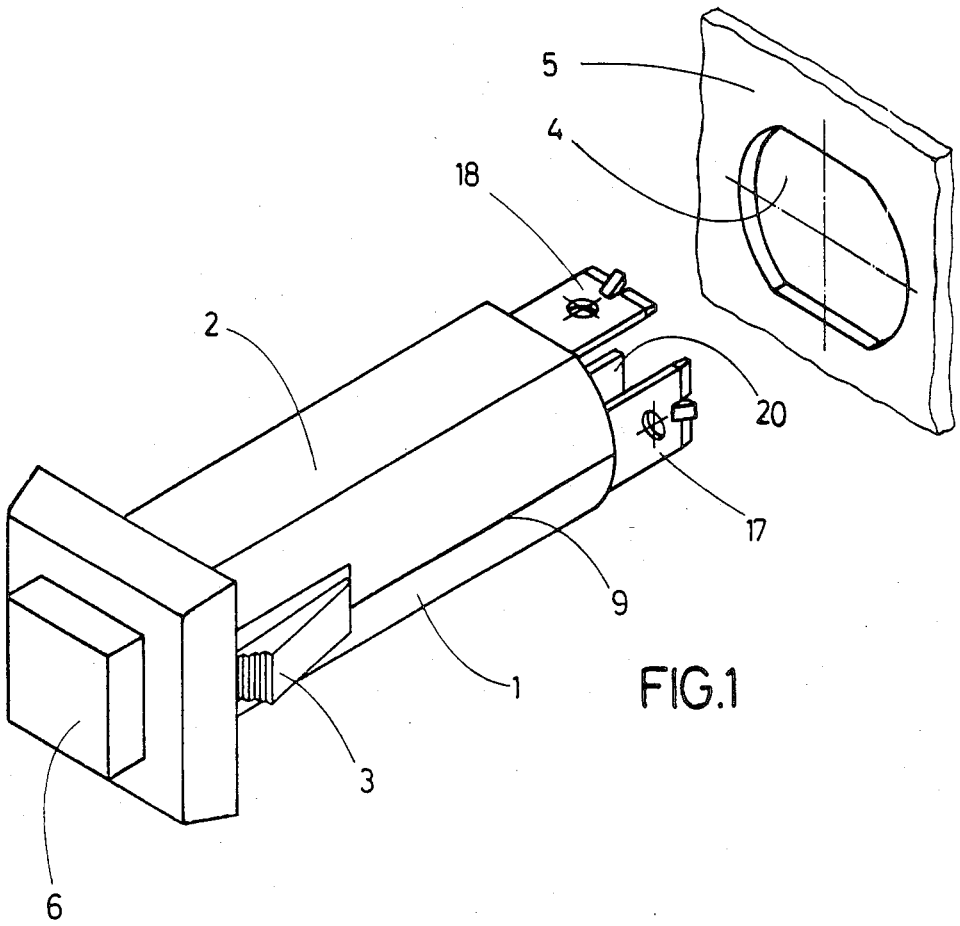
FIG. 1 is a schematic overall perspective view of a switch according to the invention and showing a double D installation opening in a switching panel.
Figure 4:
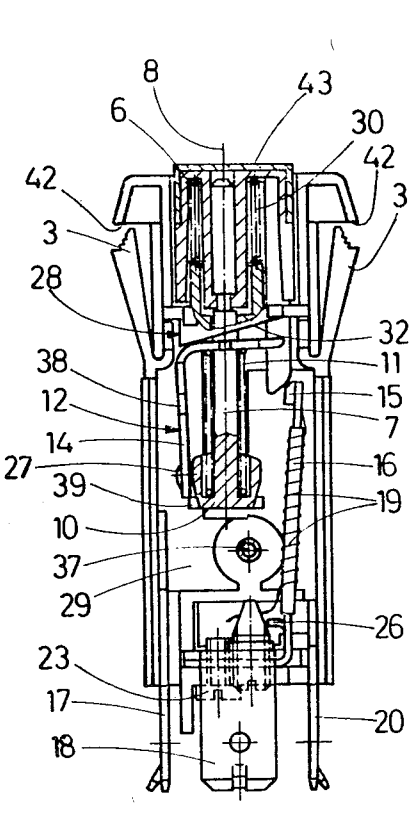
FIG. 4 is a longitudinal sectional view of the switch corresponding to FIGS. 2 and 3 with the contact bridge in the OFF position, but with the push button completely depressed.

Referring to FIG. 1, there is shown a switch housing composed of two housing halves 1, 2 which are extruded of thermoplastic material which is highly temperature resistant, resistant to creep currents and substantially flame-retardant. Additionally, the thermoplastic material has great strength which offers good resistance to bending for spring hooks 3 which serve to fasten the device in an installation opening 4 of a switching panel 5.

The switch is actuated by a push button 6 which projects at one end of the switch. Referring additionally to FIGS. 2–9, push button 6 is made of an insulated material and is fixed to a switch rod 7 likewise made of insulating material, with the axis 8 of switch rod 7 lying in the longitudinal center plane of the switch. The longitudinal center plane is simultaneously the dividing plane (dividing groove 9) between the two housing halves 1, 2 (see FIG. 1). The lower end of switch rod 7 is provided with a flange-like broadened portion 10 as an abutment for switch spring 11 which surrounds switch rod 7, with a horizontal arm 13 of a contact bridge 12 resting on the push button end of switch spring 11. Contact bridge 12 has the shape of an angle lever whose horizontal arm 13 is disposed at approximately a right angle to vertical arm 14.

In the ON position (FIG. 2), contact bridge 12 electrically connects a contact piece 15 of a bimetal member 16 with a contact terminal 17. Bimetal member 16 is fastened to the housing by means of a bimetal carrier 18 which simultaneously constitutes the terminal for the direct bimetal heating element. Bimetal member 16 is additionally surrounded by a heating coil 19 for selective indirect heating, with a voltage being applied across this heating coil 19 via heating wire terminal 20. Contact terminal 17, bimetal carrier 18 and heating wire terminal 20 are fastened in insertion slots 22 or in the dividing groove 9 between the two housing halves 1, 2 at the bottom 21 of the switch housing opposite push button side 6.

Bimetal carrier 18 and bimetal member 16, respectively, are fastened by means of a fastening screw 23 which is screwed in from the outside. The bimetal member is adjusted in a known manner by means of the conical end 24 of an adjustment screw 25 which is screwed in parallel to fastening screw 23 via a bimetal extension 26.

In the ON position, the horizontal arm 13 of contact bridge 12 is locked under the pressure of switch spring 11 behind or, more precisely, underneath contact piece 15 of bimetal member 16. In this position, horizontal arm 13 takes on a position at a right angle to axis 8 of switch rod 7 because, likewise under the pressure of switch spring 11, contact piece 27 of vertical arm 14 of contact bridge 12 rests against contact terminal 17 and is prevented from pivoting clockwise.

Switch rod 7 is mounted so as to be longitudinally displaceable in a guide piece 28 likewise made of insulating material. Guide piece 28 is fastened between contact bridge 12 and push button 6 at both housing halves 1, 2. Guide piece 28 thus partitions one portion of the interior 29 of the housing facing housing bottom 21 and accommodating the voltage carrying parts (bimetal member 16, contact piece 28, contact bridge 12, contact terminal 17) from the receiving area for push button 6 within the housing. Guide piece 28 also forms the abutment for push button spring 30 which charges push button 6 against the direction of pressure 31. On its side facing housing bottom 21, guide piece 28 is provided with a sloped face forming a sloped abutment 32. When contact bridge 12 is charged by sloped abutment 32 under the influence of switch spring 11, sloped abutment 32 forces contact bridge 12 into the sloped OFF position shown in FIG. 3. Guide piece 28 is provided with spring hooks 33 which clamp the two housing halves 1, 2 together. Moreover, guide piece 28 is provided with force fit pins 34 which mate with corresponding guide recesses 35 in housing halves 1, 2. In addition to guide recesses 35, passage openings 36 are provided in housing halves 1,2 to cooperate with spring hooks 33. Guide piece 28 also forms the final abutment for the depressed push button 6.

In the end state, the two housing halves 1, 2 are fixed together, preferably by means of a rivet 37 in their end region near the conductive terminals.

The vertical arm 14 of contact bridge 12 is provided on both sides with a recess into each of which engages a projection 39 of the broadened portion 10 of switch rod 7 if contact bridge 12 is in a corresponding position relative to broadened section 10 or relative to projections 39, namely in a sloped position in which contact bridge 12 lies against sloped abutment 32.

Push button 6 is provided with a deflection lug 40 which extends alongside switch rod 7 and which, when the push button is in its depressed position (FIGS. 4, 6, 9), deflects bimetal member 16 clockwise with respect to the drawing figure so as to release the turn-off movement. For this purpose, deflection lug 40 charges contact piece 15 of bimetal member 16 with a corresponding sloped face 41.

The end of the tubular switch housing composed of the two housing halves 1, 2 and surrounding push button 6 is provided with a flange-like abutment 42 to rest against the installation surface surrounding installation opening 4 of, for example, a switching panel 5. Push button 6 may be provided with a color coding cap 43.

Plug-in blocks 44 are shaped at terminals 17, 18, 20 to assure that the plug-in receptacles to be pushed over them can be pushed over in only one defined rotational position. Due to the arrangement of terminals 17, 18, 20 and the corresponding unlatching direction of plug-in blocks 44, the above-described creep and air paths can be reliably maintained.

The operation of the switch can be described as follows:

Manual Actuation: The switch is in the ON position shown in FIGS. 2 and 8, respectively. To turn it off, push button 6 is depressed in the depression direction shown by arrow 31 in FIG. 3. When push button 6 has almost completely entered into the housing (FIG. 4), the oblique face 41 of deflection lug 40 deflects the free end of bimetal member 16 in a clockwise direction. Contact piece 15 of bimetal member 16 thus comes out of engagement behind the horizontal arm 13 of contact bridge 12. Consequently, contract bridge 12 is pulled out of contact not only with contact piece 15 but also with contact terminal 17. Ultimately, contact bridge 12 abuts against the underside of guide piece 28. If push button 6 is then released in the usual manner, push button spring 30 will push it into its starting position in which it projects the farthest out of the housing (FIG. 3), thus simultaneously signalling that the switch is in the OFF position. At the same time, the vertical arm 14 of contact bridge 12 is released from contact with the broadened portion 10 of switch rod 7 so that the horizontal arm 13 of contact bridge 12 can lie flush against the oblique abutment 32 forming the underside of guide piece 28. Thus contact bridge 12 takes on the oblique position shown in FIG. 3 in which projections 39 of broadened portion 10 of switch rod 7 drop into recesses 38 in vertical arm 14 of contact bridge 12. Thus contact bridge 12 which is now in the OFF position is ready to be moved to the ON position again.

Figure 2:
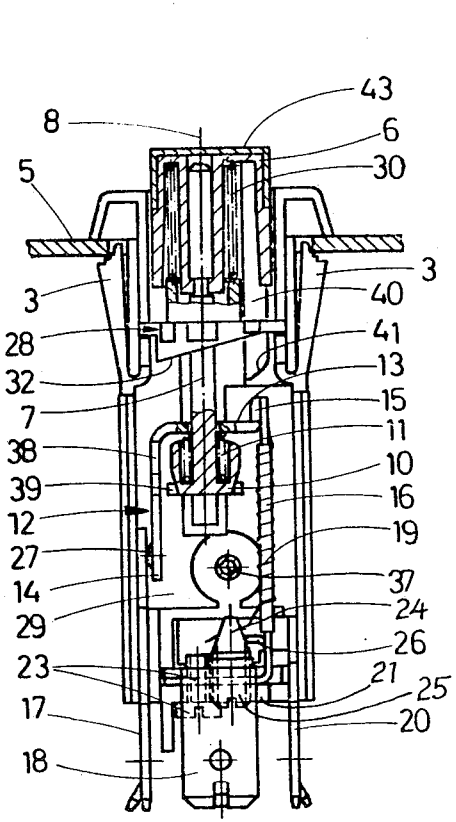
FIG. 2 is a sectional view in the longitudinal center plane of the switch of FIG. 1 in the ON position.
Figure 5:
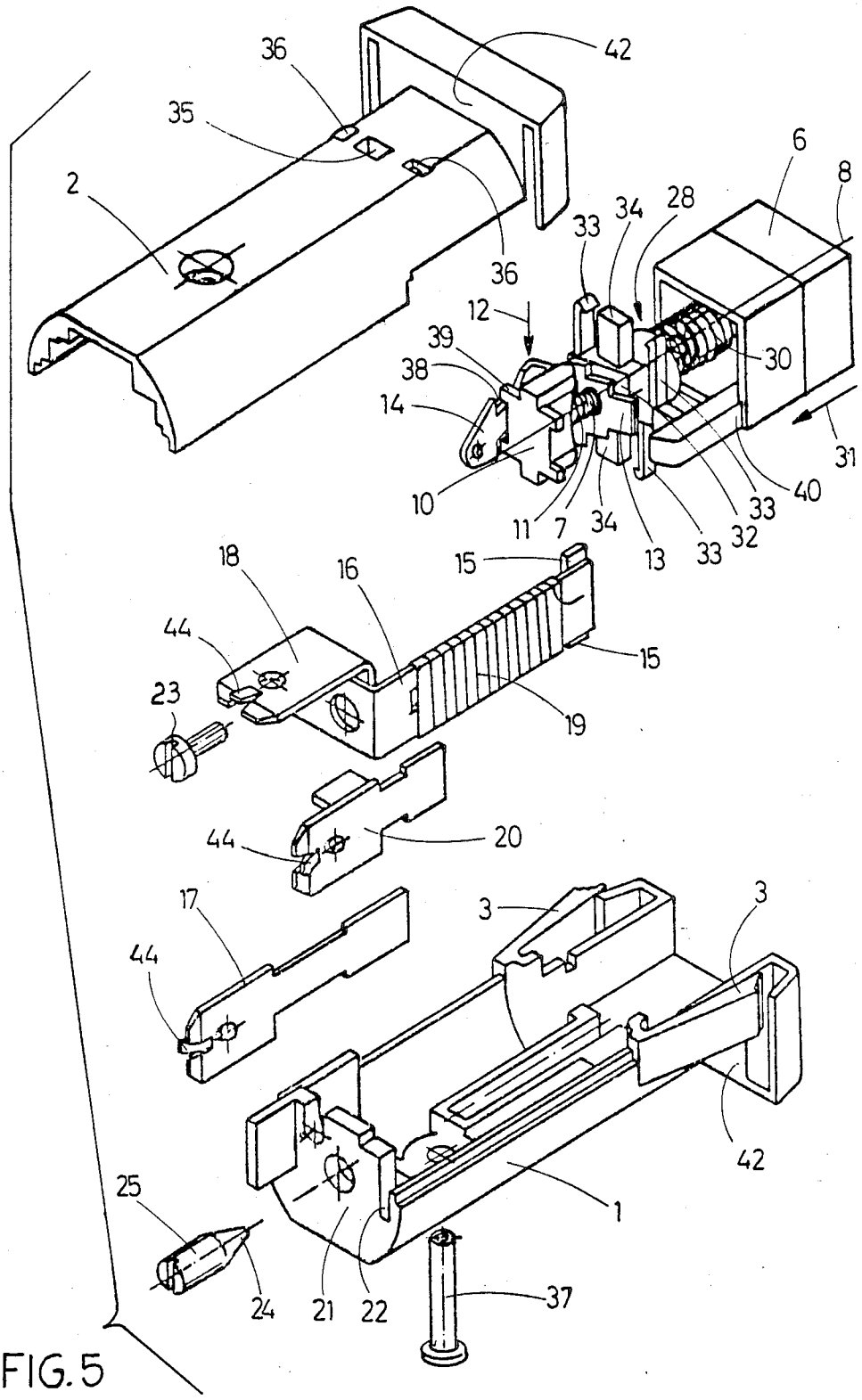
FIG. 5 is an exploded view of the individual parts of the switch according to the invention.
Figure 6:
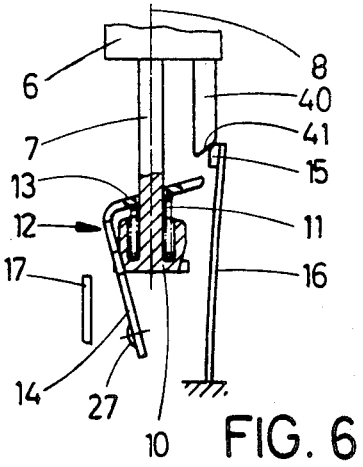
FIGS. 6 to 9 are schematic drawings of the switch in various positions of the contact bridge, with a switch latch being shown in simplified illustration.
Figure 7:
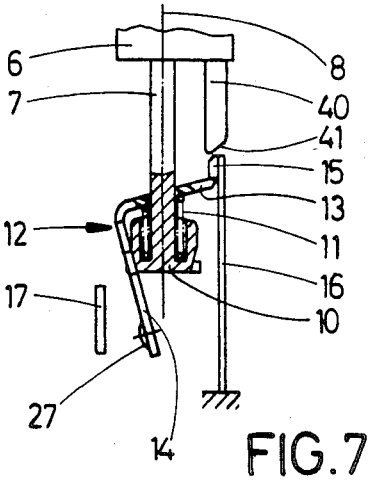
Figure 8:
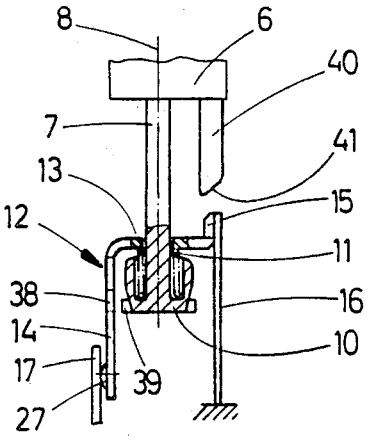
Figure 9:
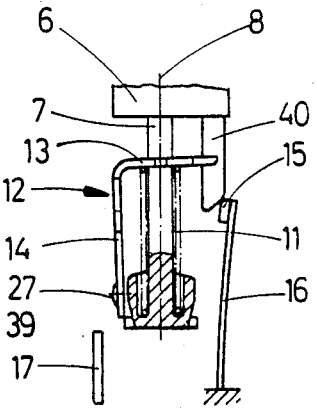

Return of the switch to the ON position is initiated by renewed depression of push button 6. Projections 39 which are engaged in recesses 38 then carry contact bridge 12 along downwardly in the direction of pressure (arrow 31). The lower dead center position is shown schematically in FIG. 6. During this movement, contact bridge 12 retains its sloped position. As it approaches the lower dead center position, deflection lug 40 deflects bimetal member 16 in a clockwise direction. If the push button is now released, deflection lug 40 will initially go out of engagement with contact piece 15 of bimetal member 16. Bimetal member 16 pivots under its own elasticity back into the vertical starting position (FIG. 7). In this vertical starting position, contact piece 15 extends into the path of the free end of horizontal arm 13 of contact bridge 12. As soon as the free end of horizontal arm 13 of contact bridge 12 comes into contact or engagement behind contact piece 15 (FIG. 7), contact bridge 12 pivots back clockwise while supporting its horizontal arm 13 on switch spring 11. Horizontal arm 13 again takes on its initial horizontal position. Contact piece 27 of vertical arm 14 suddenly comes into conductive contact with contact terminal 17. In this ON position, push button 6 projects halfway out of the housing (FIG. 2).

Figure 3:
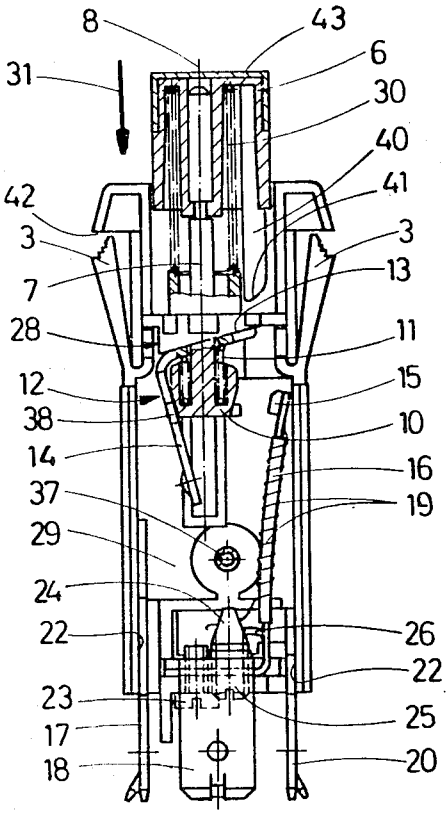
FIG. 3 is a sectional view corresponding to FIG. 2 of the switch in the OFF position.

Bimetal Actuation: If bimetal 16 is automatically deflected in a clockwise direction due to excess current, i.e. direct or indirect heating of bimetal 16, the free end of horizontal arm 13 of contact bridge 12 is released by contact piece 15. Under the pressure of switch spring 11, the contact bridge snaps into its abutment position at guide piece 28. The turn-off movement is supported by push button spring 30, which simultaneously presses the push button up into the OFF position (FIG. 3). In this position, push button 6 takes up its most projecting position outside the housing which externally indicates the OFF position of the switch. The switch is returned to the ON position by manually depressing push button 6, as described above under "Manual Actuation".

The present disclosure relates to the subject matter disclosed in German G 85 30 597.9 of Oct. 29, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. Push button overload protection switch, comprising (a) a housing having an axial direction, said housing being provided with an abutment which is oblique to said axial direction and with a contact terminal;

(b) a push button axially slidably engaged with said housing at one axial end thereof, movement of said push button toward the interior of said housing constituting a direction of push button pressure;

(c) a switch rod rigidly connected with said push button and extending in the axial direction, said switch rod having a projection;

(d) push button spring means for tensioning said push button in a direction opposite to the direction of push button pressure;

(e) a bimetal member having a contact piece;

(f) a contact bridge having first and second arms joined to form an approximately rectangular angle lever which is mounted on said switch rod, said contact bridge being freely pivotal with respect to said switch rod and displaceable in the axial direction of said switch rod, said contact bridge having an ON position in which said first arm is substantially perpendicular to said switch rod and said second arm is substantially parallel to said switch rod, said contact bridge being held in its ON position with said first arm being latched behind the contact piece when said bimetal member is in an undeflected state;

(g) switch spring means which, during turn-off of said switch, is effective in the longitudinal direction of said switch rod opposite to the direction of push button pressure for pushing the first arm of said contact bridge against the oblique abutment of said housing so that said contact bridge is brought into an oblique engagement position pivoted with respect to said ON position, said contact bridge in said oblique engagement position engaging the projection on said switch rod, wherein by actuation of said push button in the direction of push button pressure said switch spring is caused to exert pressure on the first arm of said contact bridge to pivot said contact bridge from said oblique engagement position into said ON position whereby said first arm engages behind the contact piece of said bimetal member which is in its undeflected state and said second arm is brought into its position parallel to said switch rod and pressing against the contact terminal of said housing; and (h) a deflection lug fixed to said push button and disposed adjacent the switch rod so that, when said push button is depressed substantially completely a turn-off movement is effected wherein said deflection lug deflects said bimetal member by charging it directly, causing said contact piece to unlatch said first arm, allowing said switch spring means to pivot said contact bridge into the oblique engagement position.

2. Switch as defined in claim 1, wherein said housing has a bottom at an axial end opposite to said push button, said bimetal member is fastened to said bottom and projects approximately parallel to said switch rod in a direction toward said push button; and said switch further comprises electrical terminals which are brought through the bottom of said housing, wherein said bimetal member, said switch rod, said contact bridge and said contact terminal lie approximately in a longitudinal center plane of said housing; said deflection lug extends outside said longitudinal center plane parallel to said switch rod; and said bimetal member has a free end to which said contact piece is attached, said contact piece extending laterally of said bimetal member into the range of movement of said deflection lug.

3. Switch as defined in claim 1, wherein said housing has an essentially tubular cross section which is adapted to the cross section of a conventional installation opening for a meltable fuse.

4. Switch as defined in claim 1, wherein said housing is composed of two interconnected housing halves made of insulating material, with the plane of division of said housing halves coinciding approximately with the longitudinal center plane of said switch.

5. Switch as defined in claim 4, and further comprising a guide piece made of insulating material and being fastened to both of said housing halves between said contact bridge and said push button, said guide piece partitioning the interior of housing so that all voltage carrying parts of said switch are on one side of said guide piece, and wherein said guide piece is disposed near the push button end of said housing and includes an abutment for said push button spring means.

6. Switch as defined in claim 5, wherein said guide piece is provided with a surface which constitutes said oblique housing abutment.

7. Switch as defined in claim 5, wherein said guide piece includes spring hooks which clamp said two housing halves together.

8. Switch as defined in claim 5, wherein said guide piece includes force fit pins which cooperate with said housing halves.

9. Switch as defined in claim 5, wherein said guide piece forms a final abutment for said push button when said push button is depressed.

10. Switch as defined in claim 4, wherein said two housing halves are riveted together in a region adjacent the bottom of said housing.

11. Switch as defined in claim 4, wherein said housing has an essentially tubular cross section which is adapted to the cross section of a conventional installation opening for a meltable fuse, and at the end of said housing adjacent said push button said housing surrounds said push button and is provided with a flange-like abutment for contact with an installation surface area surrounding an installation opening, and at least one of said two housing halves is provided with one-piece, shaped-on spring hooks which, after said switch is inserted into the installation opening, block the removal of said switch from such opening.

* * * * *